US005255707A

United States Patent [19]

Kojima et al.

[11] Patent Number: 5,255,707

[45] Date of Patent: Oct. 26, 1993

[54] DOUBLE REED APPARATUS FOR MANUFACTURING A WOVEN SLIDE FASTENER STRINGER

[75] Inventors: Masaaki Kojima; Yoshinori Nakada, both of Kurobe, Japan

[73] Assignee: Yoshida Kogyo K. K., Tokyo, Japan

[21] Appl. No.: 959,091

[22] Filed: Oct. 9, 1992

[30] Foreign Application Priority Data

Oct. 9, 1991 [JP] Japan ..... 3-327988

[51] Int. Cl.[5] ..... D03D 49/68

[52] U.S. Cl. ..... 139/116.1; 139/18; 139/442

[58] Field of Search ..... 139/442, 384 B, 35, 139/11, 116.1, 18

[56] References Cited

U.S. PATENT DOCUMENTS

| | | | |
|---|---|---|---|
| 3,258,034 | 6/1966 | Gerlach | 139/11 |
| 4,127,147 | 11/1978 | Frohlich | 139/442 X |
| 4,278,111 | 7/1981 | Takahashi et al. . | |
| 4,682,635 | 7/1987 | Ofusa et al. | 139/118 X |
| 4,836,251 | 6/1989 | Frohlich | 139/118 X |
| 5,035,267 | 7/1991 | Shimono | 139/384 B X |

*Primary Examiner*—Andrew M. Falik

[57] ABSTRACT

An apparatus for manufacturing a woven slide fastener stringer includes a first reed for beating a filling yarn through a shed of warp threads against the fell of a tape being woven and a second reed for beating a monofilamentary fastener element having successively interconnected convolutions in place along a longitudinal edge of the tape. The first and second reeds are actuated to alternate in their respective beating-up movements. The second reed is positioned to beat the element convolutions substantially centrally thereof away from their coupling head portions.

14 Claims, 5 Drawing Sheets

DOUBLE REED APPARATUS FOR MANUFACTURING A WOVEN SLIDE FASTENER STRINGER

BACKGROUND OF THE INVENTION

1. Field of the Invention

This invention relates to an apparatus for manufacturing a slide fastener stringer having a woven tape and a row of helically coiled fastener elements woven into the tape along a longitudinal edge thereof simultaneously as the tape is woven.

2. Prior Art

It has been heretofore proposed to utilize a weaving apparatus or loom for producing a continuous length of slide fastener stringer comprised of a support tape woven simultaneously with the weaving of a row of successive fastener elements typically of a helical coil structure into and along one longitudinal edge of the tape. An advanced apparatus has incorporated an additional or second reed separate from the main tape weaving reed for beating coiled fastener elements successively up into proper position on the tape edge. A typical example of such apparatus is disclosed in Japanese Patent Publication No. 57-35964 in which the second reed is arranged to operate in synchronism with the main reed and located externally of a mandrel so as to beat up the fastener elements adjacent their coupling head portions in alignment with the fell of the woven tape. This prior art device however has a drawback in that simultaneous beating-up operation of the main and second reeds would impart severe repeated shock upon that portion of the mandrel which lies therebetween at the fell of the tape, resulting in deformed on otherwise damaged mandrel hence with fastener elements deformedly shaped thereon, and further in that since the fastener elements are beaten up at the sides of their coupling head portions successively one against another, they are prone to shift off in the longitudinal direction of the tape and settle in slanted position relative to the plane of the tape, leading to malfunctioning of the slide fastener.

SUMMARY OF THE INVENTION

With the foregoing drawbacks of the prior art in view, the present invention seeks to provide an improved apparatus for manufacturing a woven slide fastener stringer which incorporates means of settling a continuous fastener element into proper operative position on a woven support tape without deforming or otherwise impairing a mandrel on which a monofilament material is wound and shaped into for example a helical coil structure.

The above and other objects and features of the invention will appear manifest from the following detailed description taken in conjunction with the accompanying drawings.

According to the invention, there is provided an apparatus for manufacturing a woven slide fastener stringer having a woven support tape and a continuous fastener element woven into and along a longitudinal edge thereof, the apparatus comprising: means of weaving a tape with warp threads and weft or filling yarns to form an elongate tape; a mandrel having a shaping portion extending substantially parallel with the warp threads beyond the fell of the tape and adapted to wind and shape thereon a monofilament into a helical coil structure having a row of successively interconnected convolutions each having a coupling head portion, a pair of upper and lower leg portions and a heel portion; a first reed for beating the filling yarns in a warp shed against the fell of the tape; a second reed for beating the row of convolutions successively one after another in place along the longitudinal edge of the tape; and an actuating means of pivotally moving the first and second reeds toward and away from the fell of the tape, the actuating means being controlled in timed relation such that a beating-up operation of the first reed alternates with that of the second reed.

DETAILED DESCRIPTION OF THE INVENTION

Figure 1:
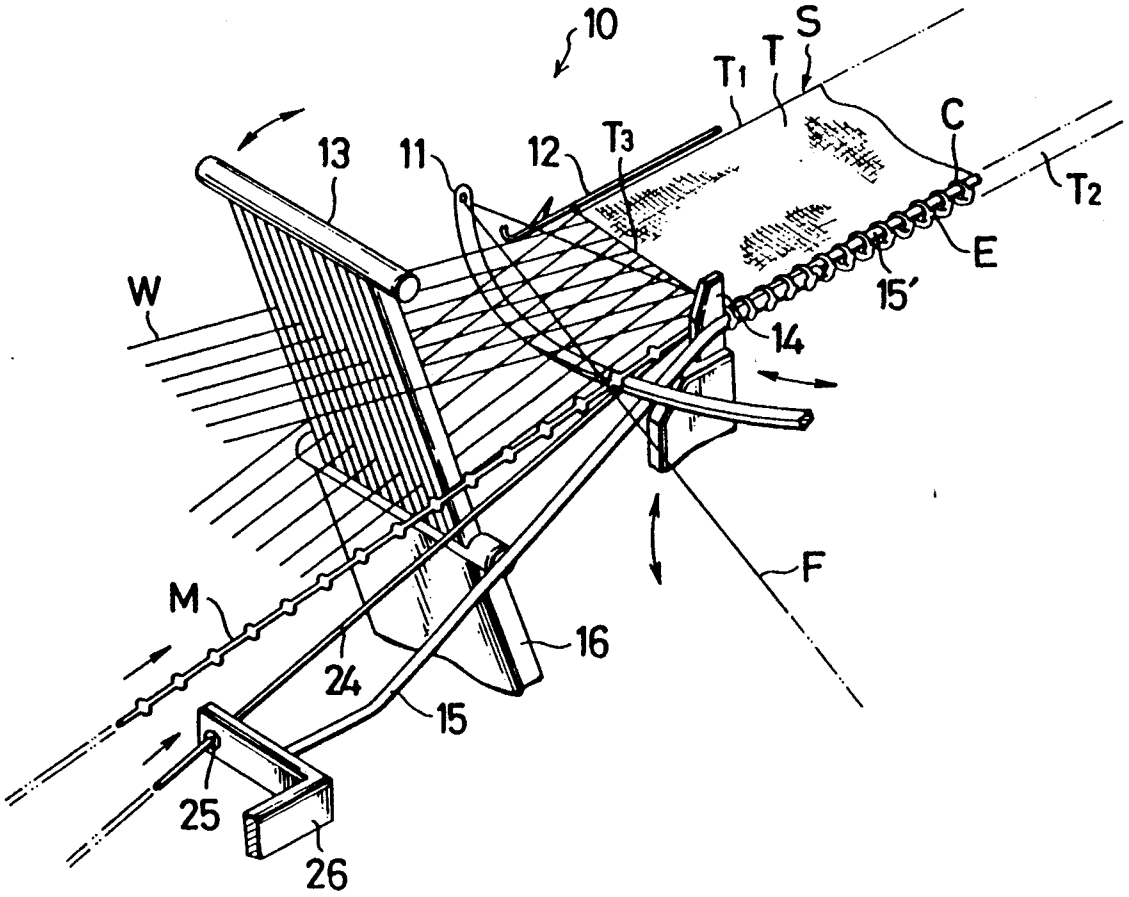
FIG. 1 is a perspective view of a portion of an apparatus embodying the invention, showing a second reed in beating-up position with a first reed retracted.
Figure 3:
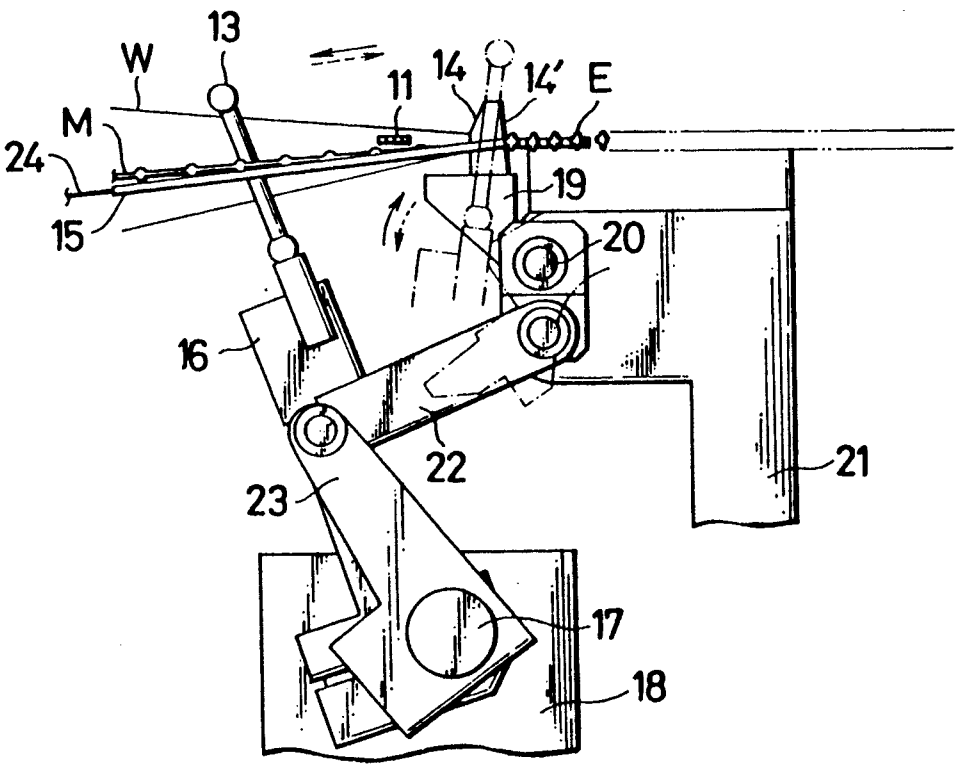
FIG. 3 is a side elevational view of the apparatus, showing the first and second reeds connected to a drive means.

Referring now to the drawing and FIGS. 1 and 3 in particular, there are shown those operating devices of a weaving machine or loom which are associated with the inventive apparatus generally designated at 10 for manufacturing a woven slide fastener stringers S.

The apparatus 10 includes a harness (not shown) for forming a shed by selectively raising and lowering a plurality of warp threads W, a filling yarn carrier or shuttle 11 reciprocable through the shed for inserting a filling yarn or weft thread F, a latch needle 12 movable along one longitudinal edge $T_1$ of a woven tape T for receiving the filling yarn F in a double pick from the carrier 11 and interlacing the same with the warp threads to form a selvedge, a first or main reed 13 of a conventional construction for beating the filling yarn F in the shed against a fell $T_3$ of the tape $T_1$ and a second or auxiliary reed 14 having a blade 14' for beating successive convolutions C of a continuous coiled fastener element E one after another in place along the other longitudinal edge $T_2$ of the tape T.

Figure 6:
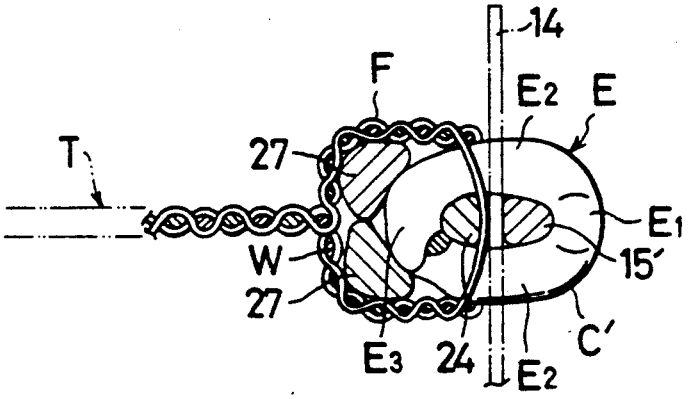
FIG. 6 is a diagrammatic cross-sectional view utilized to explain the relative positions of the second reed, the element and the tape.

An elongate monofilament M of a plastic material such as nylon, polyester and the like is wound around a mandrel 15 by means of a rotor (not shown) and formed thereon into a helically coiled structure comprised of a succession of interconnected convolutions C each, as better shown in FIG. 6, having a coupling head portion $E_1$, a pair of upper and lower leg portions $E_2$ and a connecting or heel portion $E_3$ merging into adjacent convolutions. The monofilament M has a multiplicity of flattened portions M' spaced at predetermined intervals therealong, such flattened portions M' being formed as by stamping and folded over to form the coupling head portion $E_1$ in a manner well known in the art.

As shown in FIG. 3, the first or main reed 13 is connected to a connecting block 16 which is in turn connected to a rocking shaft 17 rotatably mounted on a first frame member 18. The rocking shaft 17 is driven by a suitable drive means (not shown) to move the first reed 13 pivotally toward and away from the fell $T_3$ of the tape T during a cycle of its beating-up operation in a manner well known in the art.

The second reed 14 is connected to a support block 19 which is in turn connected to a pivotal pin 20 pivotably mounted on a second frame member 21 and connected through links 22 and 23 to the rocking shaft 17. Thus, rocking or pivotal movement of the shaft 17 causes the second reed 14 to move pivotally toward and away from the fell of the tape T between a solid-line position in which the second reed 14 beats a last-formed convolution C' of the fastener element E against a preceding convolution and a phantom-line position in which the second reed 14 is retracted downwardly away from the path of the first reed 13 or below the position of the mandrel 15 lest the second reed 14 should hit the monofilament M being wound on the mandrel 15.

Upward pivotal movement of the second reed 14 into its solid-line position is timed so that this begins shortly after the carrier 11 has moved through the shed to leave a double pick of the filling yarn F therein, thus avoiding mutual interference of the reed 14 and the carrier 11.

The respective pivotal movements of the first reed 13 and the second reed 14 are controlled in timed relation such that when the first reed 13 arrives at its phantom-line position in which to beat the filling yarn F in the shed against the fell of the tape T being woven, the second reed 14 is retracted to its phantom-line position below the level of the mandrel 15, and when the second reed 14 moves up into its solid-line position in which to beat one of the convolutions C of the fastener element E into position on the longitudinal edge $T_2$ of the tape T remote from the selvedge V, the first reed 13 is retracted to its solid-line position away from the fell of the tape T, as better illustrated in FIG. 3. Thus, the beating-up operation of the first reed 13 alternates with that of the second reed 14 with the result that the mandrel 15, particularly an element-shaping portion 15' thereof extending beyond the fell, is held substantially free from mechanical shocks which would otherwise deform or damage the mandrel 15.

Mechanically, when the link 23 rotates clockwise as per FIG. 3, the connecting block 16 and the reed 13 rotate clockwise to the dashed position while at the same time the rotation of the link 23 causes the translation of the link 22 approximately to the right in FIG. 3, which pivots the support block 19 about the pivotal pin 20 and thus rotates the second reed 14 counterclockwise to the dashed position.

Figure 2:
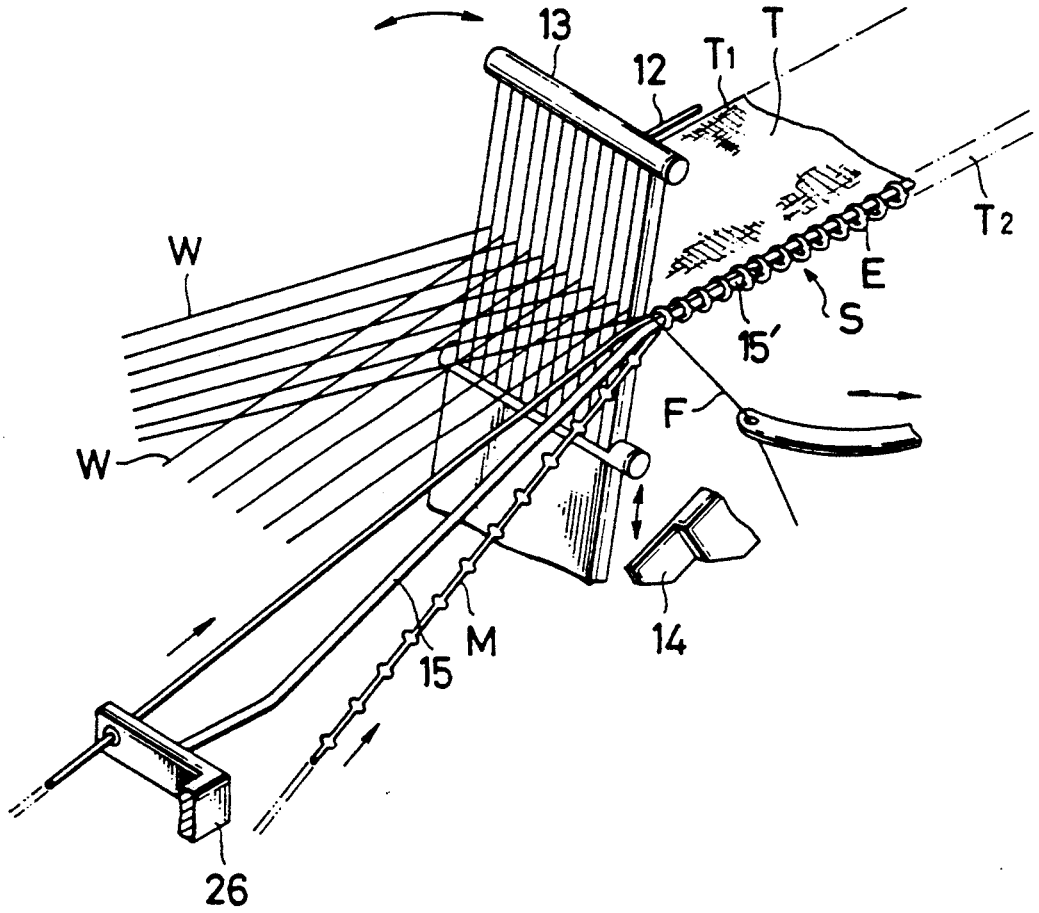
FIG. 2 is a perspective view of the apparatus, showing the first reed in beating-up position with the second reed retracted.

Designated at 24 is a core thread which is supplied, passing through a guide slot 25 in a support bracket 26 to which the mandrel 15 is secured, as shown in FIGS. 1 and 2. The core thread 24 is inserted through the convolutions C of the fastener element E adjacent to the heel portions $E_3$ thereof to stabilize the normal posture of the fastener element E, as better shown in FIG. 6.

Figure 4:
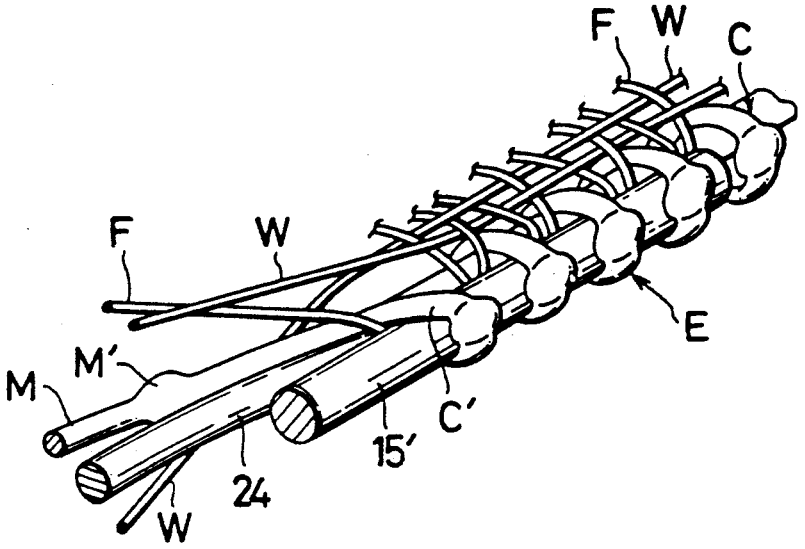
FIG. 4 is a perspective view on enlarged scale of a continuous coiled fastener element shown prior to beating.
Figure 5:
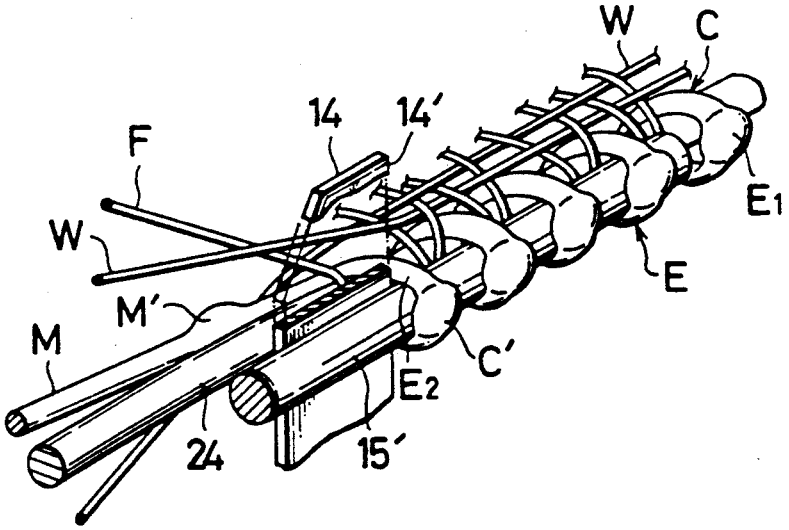
FIG. 5 is a view similar to FIG. 4 but showing the fastener element being beaten in place.

FIGS. 4 through 6 inclusive are utilized to explain the manner in which the fastener element E is woven into the tape T along the longitudinal edge $T_2$ thereof. The monofilament M is wound on the element-shaping portion 15' of the mandrel 15 with opposite ends of the flattened portions M' folded over, leaving successive coupling head portions $E_1$ exposed beyond the extremity of the longitudinal edge $T_2$ of the tape T. FIG. 4 shows the last-formed convolution C' partially embracing the core thread 24 from one direction, in which instance the filling yarn F passes from the opposite direction around and urges the core thread 24 toward the heel portion $E_3$ of the fastener element E. FIG. 5 shows the second reed 14 in beating-up operation in which its blade 14' lies substantially at right angles to the general plane of the tape T being woven and beats the last-formed convolution C' of the fastener element E substantially at the center of the leg portions $E_2$ away from the coupling head portion El between the element-shaping portion 15' of the mandrel 15 and the core thread 24, urging the core thread 24 and the filling yarn F both inwardly toward the web of the tape T. This is better illustrated in FIG. 6, from which it will be seen that the beating-up operation of the second reed 14 keeps the successively interconnected convolutions C of the fastener element E stably in proper position relative to the tape edge T', with the filling yarn F slightly slackened in contact with the mandrel 15 to eliminate the possibility of the yarn F being torn under the influence of tension applied by the carrier 11.

Designated at 27 are additional core threads inserted between the element heel portions $E_3$ and the edge of a row of warp threads W to provide improved anchorage of the fastener element E at the tape edge $T_2$ as shown in FIG. 6. However, neither these core threads 25 nor the core thread 24 are essential for the purpose of the invention.

Various changes and modifications may be made in the specific construction of the apparatus 10 above described as appears obvious to one skilled in the art without departing from the scope of the appended claims.

What is claimed is:

1. An apparatus for manufacturing a woven slide fastener stringer having a woven support tape an a continuous fastener element woven into and along a longitudinal edge thereof, said apparatus comprising:

(a) means of weaving a tape with warp threads and weft threads or filling yarns to form an elongate tape;

(b) a mandrel having a shaping portion extending substantially parallel with said warp threads beyond a fell of said tape and adapted to wind and shape thereon a monofilament into a helical coil structure having a row of successively interconnected convolutions each having a coupling head portion, a pair of upper and lower leg portions and a heel portion;

(c) a first reed having a first surface adapted and arranged for beating the weft threads or filling yarns in a warp shed against the fell of said tape;

(d) a second reed having a second surface adapted and arranged for beating each of said convolutions successively one after another into said row of convolutions in place along the longitudinal edge of said tape; and (e) an actuating means for pivotally moving said first and second reeds toward and away from the fell of said tape, for alternately beating said weft-threads or filling yarns and said row of convolutions respectively by said first and second surfaces.

2. An apparatus according to claim 1 further comprising a guide for running a core thread adjacent said mandrel to be captured within said convolutions adjacent to said heel portion of each convolution.

3. An apparatus according to claim 1 wherein said second reed lies substantially at right angles to the plane of said tape when beating each of said convolutions and beats each of said convolutions substantially centrally of said leg portions thereof on a side of said mandrel away from said coupling head portion.

4. An apparatus according to claim 2, wherein said guide is formed in a bracket to which the mandrel is secured.

5. An apparatus according to claim 1, wherein said actuating means comprises:

a rocking shaft driven to rotate about its axis alternately in a first direction and then in an opposite second direction;

a first link connected for rotation at a base end thereof with said rocking shaft and extending radially therefrom;

a connecting block mounted for pivoting about a first end and extending to a second end which is connected to said first reed, said first link connected at its distal end to said connecting block between said first reed and said first end, the pivoting of said first link causing said connecting block to pivot about its first end;

a second link connected to said connecting block at a first end thereof;

a support block mounted at a pivotal pin at a central portion thereof and connected at a first end thereof to said second reed, said second link connected at a second end thereof to said support block on a side of said pivotal pin opposite said second reed.

6. An apparatus according to claim 5, wherein said second link, said connecting block and said first link are all connected together at a pinned connection.

7. An apparatus according to claim 6, wherein said first end of said connecting block is freely rotatable about said axis of said rocker shaft.

8. An apparatus according to claim 5 further comprising a guide for running a core thread adjacent said mandrel to be captured within said convolutions adjacent to said heel portion of each convolution.

9. An apparatus according to claim 8 wherein said second reed lies substantially at right angles to the plane of said tape when beating each of said convolutions and beats each of said convolutions substantially centrally of said leg portions thereof on a side of said mandrel away from said coupling head portion.

10. An apparatus according to claim 5 wherein said second reed lies substantially at right angles to the plane of said tape when beating each of said convolutions and beats each of said convolutions substantially centrally of said leg portions thereof on a side of said mandrel away from said coupling head portion.

11. An apparatus according to claim 1, wherein said actuating means comprises:

a means for pivoting said first reed toward and away from the link of said tape, and a link connecting said means for pivoting and said second reed, said link connected to said second reed to cause reverse pivoting of said second reed upon pivoting of said first reed.

12. An apparatus according to claim 11 further comprising a guide for running a core thread adjacent said mandrel to be captured within said convolutions adjacent to said heel portion of each convolution.

13. An apparatus according to claim 12 wherein said second reed lies substantially at right angles to the plane of said tape when beating each of said convolutions and beats each of said convolutions substantially centrally of said leg portions thereof on a side of said mandrel away from said coupling head portion.

14. An apparatus according to claim 11 wherein said second reed lies substantially at right angles to the plane of said tape when beating each of said convolutions and beats each of said convolutions substantially centrally of said leg portions thereof on a side of said mandrel away from said coupling head portion.

* * * * *